US005291525A

United States Patent [19]

Funderburk et al.

[11] Patent Number: 5,291,525

[45] Date of Patent: Mar. 1, 1994

[54] SYMMETRICALLY BALANCED PHASE AND AMPLITUDE BASE BAND PROCESSOR FOR A QUADRATURE RECEIVER

[75] Inventors: Dion M. Funderburk; Sangil Park, both of Austin, Tex.; Peter J. McLane, Kingston, Canada

[73] Assignee: Motorola, Inc., Schaumburg, Ill.

[21] Appl. No.: 864,278

[22] Filed: Apr. 6, 1992

[51] Int. Cl.[5] ..... H04C 27/38

[52] U.S. Cl. ..... 375/98; 455/235.1

[58] Field of Search ..... 375/39, 98, 97, 94, 375/81, 97; 329/304, 307, 306, 308; 455/235.1, 239.1, 240.1, 250.1

[56] References Cited

U.S. PATENT DOCUMENTS

| | | | |
|---|---|---|---|
| 4,546,322 | 10/1985 | Crutcher | 375/81 |
| 4,641,377 | 9/1987 | Yoshihara et al. | 375/97 |
| 4,740,996 | 4/1988 | Somer | 375/76 |
| 4,811,423 | 3/1989 | Eastmond | 455/235.1 |
| 4,910,467 | 3/1990 | Leitch | 329/306 |
| 5,014,316 | 5/1991 | Marrah et al. | 329/306 |
| 5,042,052 | 8/1991 | Roberts | 375/39 |

OTHER PUBLICATIONS

Henriquez et al. IEEE Proceedings Sample Rate Conversion for Audio Processing Apr. 1990.

Temerinac et al. IEEE Transaction on Broadcasting MF-AM Stereo Broadcasting; The choice of Modulation p. 81 col. 1 & 2.

"Introduction to Motorola C-Quam AM stereo System" published by Motorola, Inc. in 1985; pp. 1 through 11.

"DSP56000/DSP56001 Digital Signal Processor User's Manual" published by Motorola, Inc. in Nov., 1990; pp. 52, 53, 85, 86, 112-119, 127-144, 170, 171, 185-189, 206, and 207.

*Primary Examiner*—Stephen Chin
*Assistant Examiner*—Paul Loomis
*Attorney, Agent, or Firm*—Elizabeth A. Apperly

[57] ABSTRACT

A digital receiver (10) has a symmetrical base band processor (28, 30, 32, 34, and 36) which concurrently provides a left and a right channel of audio information. Because of the symmetrical design of the base band processor, each of the left and right channels of information has perfectly balanced phase and amplitude with respect to each other. The base band processor includes an adaptive gain compensator (28), multipliers (30, 32), and high pass filters (34, 36). Compensator (28) iteratively derives a gain factor which is multiplied by both an in-phase component and a quadrature component of a quadrature modulated input signal to respectively provide a composite of the left and right channels and a difference between the left and right channels. Subsequently, adders (44, 48) arithmetically manipulate the composite and difference of the channels to separate the left and the right audio information.

11 Claims, 2 Drawing Sheets

SYMMETRICALLY BALANCED PHASE AND AMPLITUDE BASE BAND PROCESSOR FOR A QUADRATURE RECEIVER

CROSS REFERENCE TO RELATED APPLICATION

This application is related to a copending patent application filed previously and entitled:

"A CIRCUIT AND METHOD FOR PHASE ERROR CORRECTION IN A DIGITAL RECEIVER" by Dion M. Funderburk et al., Ser. No. 07/743,641.

FIELD OF THE INVENTION

This invention relates generally to a communications system, and more particularly to a receiver in a communications system.

BACKGROUND OF THE INVENTION

During transmission of an information signal from a transmitter to a receiver in a communications system, the information signal typically modulates a carrier signal. The information signal may modulate the carrier signal using a wide variety of methods, such as amplitude, phase, or frequency modulation.

In an amplitude modulated (AM) stereo system, the amplitude of the carrier signal is typically modulated by the information signal such that a substantial amount of information may be transmitted in a relatively small band of frequencies. As well, stereo information associated with the transmitted signal may also be transmitted within the frequency band. Several systems for transmission and reception of AM stereo information have been developed through industry use. Each system implements a method for providing two audio channels within a predetermined band of frequencies with high quality stereo sound and very little interference. However, one of the standards, an AM stereo system which uses quadrature amplitude modulation, is used most often and is, therefore, a de facto industry standard.

An industry standard AM stereo system licensed by Motorola, Inc., under the trademark "C-QUAM" is referred to as a Compatible Quadrature Amplitude Modulation stereo system. The "C-QUAM" stereo system typically provides stereophonic information using amplitude modulation for a main information signal, and a quadrature type of phase modulation for a stereo information signal. Quadrature phase modulation is used to separate a composite of a left channel (L) and a right channel (R) of the stereo information signal, and a difference between the left and the right channels, by a phase angle of 90 degrees for transmission. A signal broadcast using the C-QUAM stereo system must then be separated into the composite of and the difference between the left channel and the right channel of the stereo information signal at a receiver.

In a "C-QUAM" stereo receiver, stereophonic components are typically extracted from a broadcast signal using standard analog circuits. The broadcast signal is converted to a pure quadrature information signal, and a quadrature demodulator is then used to extract both the composite and difference of the left and the right channels of the broadcast signal. If the broadcast signal has only the composite of the left and the right channels of the broadcast signal, the broadcast signal is monaural, or has no stereo components. The stereo components are transmitted as the difference between the left and the right channels of the broadcast signal.

Before the broadcast signal is input to the quadrature demodulator, the signal must be converted to an original transmitted quadrature signal which contains phase modulation components. This is accomplished by gain modulating the broadcast signal. To convert the broadcast signal to a base band signal, the broadcast signal must be demodulated with both an envelope detector and a sideband detector. The envelope detector demodulates the broadcast signal to provide a composite signal of the left and right channels of the broadcast signal. Similarly, the sideband detector demodulates the gain modulated broadcast signal to provide a difference signal indicating a difference between the left and right channels of the broadcast signal. The signals provided by both the envelope detector and the in-phase component of the sideband detector are then compared and the resultant error signal gain modulates the inputs of the sideband detector. Each of the composite and difference signals is then provided to a logic circuit referred to as a "matrix." The matrix processes each of the composite and difference signals to output a separate left and right channel signal. For further information on the operation of a "C-QUAM" encoder and receiver, refer to "Introduction to the Motorola "C-QUAM" AM Stereo System" published by Motorola, Inc. in 1985.

Although an analog solution adequately demodulates the base band signal and subsequently separates the base band signal into a left and a right stereo signal, the signal quality of the resulting left and right stereo signals is limited by the nature of the analog solution. For example, during the operation performed by the matrix, each of the composite and difference signals must have phase and amplitudes which are perfectly balanced. If the signals do not have balanced phases and amplitudes, the left and right channels of the base band signal are mixed and the resulting sound is distorted. With precise design and implementation, an analog solution may adequately balance both the phase and the amplitude of each of the composite and difference signals such that distortion is not readily noticeable. However, such precision is difficult to achieve.

Additionally, analog circuitry typically approximates a demodulation function. Therefore, the sound provided by an analog version of the C-QUAM receiver must be carefully monitored and processed to provide an audio sound which simulates the sound originally transmitted. As well, because the analog solution requires several components which are discrete, noise is produced during demodulation and during the transmission of information between each of the components. Additionally, in typical analog implementations of C-QUAM receivers, gain modulation is performed on an audio signal at the input of the C-QUAM receiver. Because the audio signal is typically sampled at a high frequency at the input, the precision and accuracy of the gain modulation operation may be limited by the speed with which the operation must be performed. Phase error and/or frequency error introduced during the demodulation may also result in increased distortion in the sound output by the analog version of the C-QUAM stereo system.

Therefore, a need exists for an AM stereo receiver which demodulates a broadcast signal to produce a high quality stereo signal. The stereo receiver should also not add any phase error or amplitude components which might distort the broadcast signal. Additionally, the AM stereo receiver should not introduce any extraneous noise which would further degrade the quality of the stereo sound. As well, the AM stereo receiver should also provide the stereo signal in a timely and economical manner.

SUMMARY OF THE INVENTION

The previously mentioned needs are fulfilled with the present invention. Accordingly, there is provided, in one form, a circuit and method of operation for asymmetrically balanced phase and amplitude base band processor for a quadrature receiver having an envelope detector. The quadrature receiver receives a demodulated signal with an in-phase component and a quadrature component. The envelope detector provides an envelope signal in response to both the in-phase component and the quadrature component. The base band processor includes an adaptive gain circuit for providing a gain coefficient. The adaptive gain circuit has a first input coupled to the envelope detector for receiving the envelope signal and a second input for receiving the in-phase component. The base band processor also includes a first logic circuit for logically combining the gain coefficient and the in-phase component of the demodulated signal to provide a composite signal. The first logic circuit is coupled to the adaptive gain means for receiving the gain coefficient. The base band processor also includes a second logic circuit for logically combining the gain coefficient and the quadrature component of the demodulated signal to provide a difference signal. The difference signal and the composite signal are concurrently provided. The second logic circuit is coupled to the adaptive gain means for receiving the gain coefficient.

These and other features, and advantages, will be more clearly understood from the following detailed description taken in conjunction with the accompanying drawing.

DETAILED DESCRIPTION OF A PREFERRED EMBODIMENT

The present invention provides a digital base band processor circuit and method of operation which demodulates a broadcast signal to provide a balanced left and right channel of an audio signal in an economical and timely manner. The digital base band processor circuit and method of operation described herein provide the left and right channels of the audio signal without distortion due to an imbalance of either phase or amplitude. The left and right channels of an audio information signal are provided to an external user without a need for balancing either the phase or amplitude of each of the channels. Because of asymmetry in analog receivers, an in-phase and a quadrature component of an information input to the receiver must be balanced to correctly provide a corresponding left and right channel of a demodulated audio signal. Therefore, previous analog solutions have required additional, relatively complex circuitry to correctly balance the in-phase and quadrature components of the input information signal to correctly provide the left and right channels of the demodulated audio signal. Therefore, the audio sound produced by the digital base band processor circuit is improved without the complicated circuitry typically required by previous analog solutions.

Additionally, the digital base band processor described herein provides a truly digital implementation of a base band processor in which no noise is introduced by discrete components. Digital implementations are typically integrated in a single circuit and extraneous noise is typically not produced. Another feature of the implementation of the invention described herein is that a gain modulation operation necessary to separate the left and the right channels of the audio signal is performed after an input signal has been demodulated to form an in-phase and a quadrature component. At this point, the gain modulation operation may be performed at a lower frequency. As was previously mentioned, the gain modulation operation will provide a more accurate and precise result when performed at a lower frequency. Additionally, noise inherent in the input signal may be removed before being processed by the gain modulation operation such that the noise is not amplified and processed as part of the stereo information. As an end result, the signal quality of the left and right audio channels provided by the digital implementation of the C-QUAM receiver described herein is greatly improved over typical analog solutions. Signals are not distorted by an imbalance of either phase or amplitude, by noise between each component, or by noise which is inherent in the input signal. Therefore, clearer, truer audio sound is provided by the digital implementation of the C-QUAM receiver described herein. Additionally, although discussed below in the context of a digital "C-QUAM" stereo system, the present invention may also be implemented in communication systems ranging from a modem to any receiver system.

Figure 1:
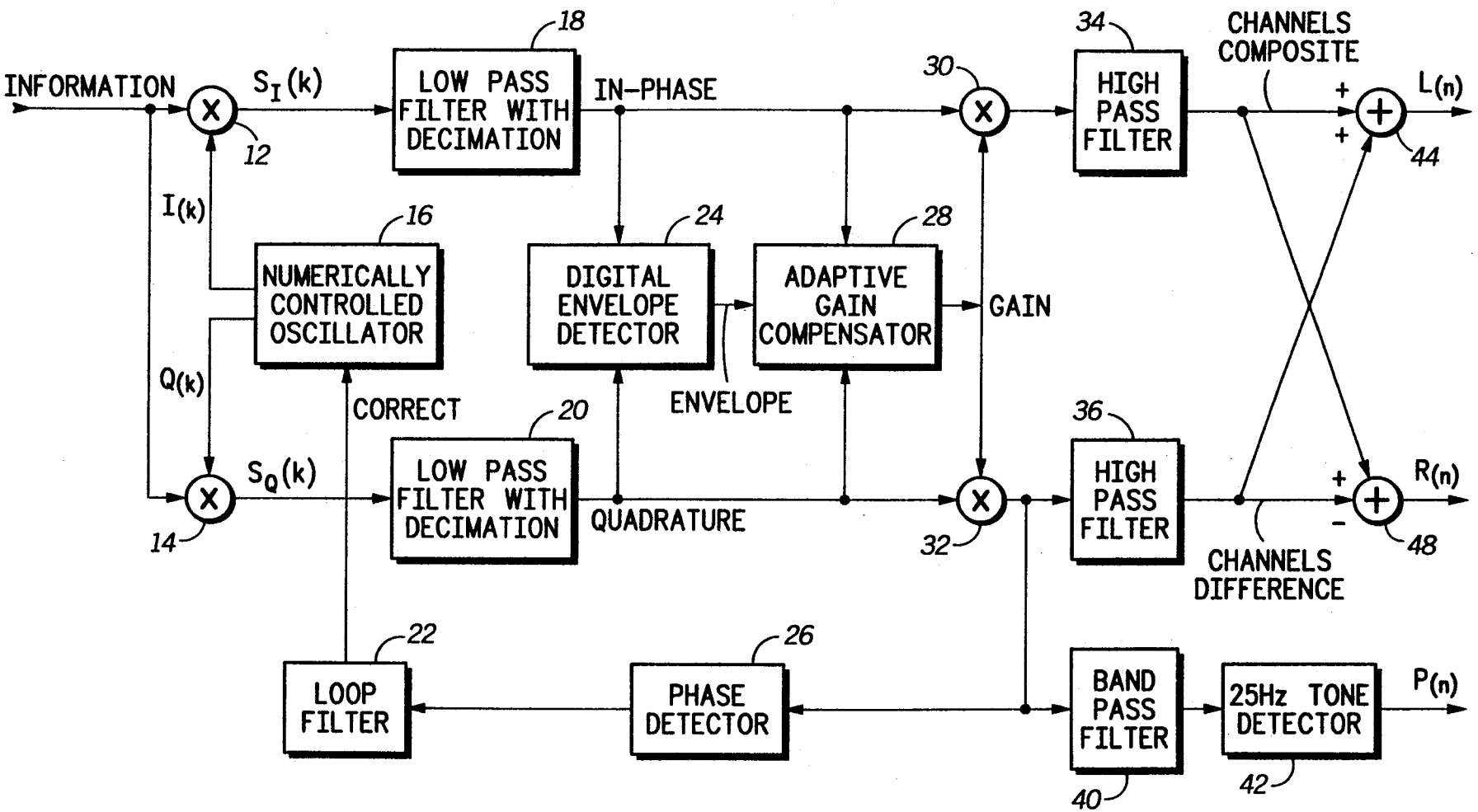
FIG. 1 illustrates in block diagram form a balanced amplitude and phase base band processor in accordance with the present invention.

FIG. 1 illustrates an implementation of a "C-QUAM" stereo receiver system 10 having a base band processor in accordance with the present invention. The base band processor includes an adaptive gain compensator 28, a multiplier 30, a multiplier 32, a high pass filter 34, and a high pass filter 36. In addition to the components of the base band processor, "C-QUAM" stereo receiver system 10 also has a multiplier 12, a multiplier 14, a numerically controlled oscillator 16, a first low pass filter with decimation 18, a second low pass filter with decimation 20, a loop filter 22, a digital envelope detector 24, a phase detector 26, a band pass filter 40, a 25 Hz tone detector 42, a first adder 44, and a second adder 48. In the implementation described herein, loop filter 22, phase detector 26, and numerically controlled oscillator 16 are used to digitally correct the phase error component of the modulated information signal.

A digital, modulated information signal labeled "Information" is provided to the receiver system 10. The Information signal is typically an analog signal which has been translated to lower frequency, converted by an analog to digital converter (not shown) to a digital signal, and has been transmitted by a "C-QUAM" transmitter (not shown) to receiver system 10.

The Information signal is provided to a first input of both multiplier 12 and multiplier 14. A cosine value of a phase corrected intermediate frequency (IF) signal is labeled "I(k)" and is provided to a second input of multiplier 12. Similarly, a sine value of the phase corrected intermediate frequency signal is labeled "Q(k)" and is provided to a second input of multiplier 14.

An output of multiplier 12 is labeled $S_I(k)$ and provides an in-phase component of the modulated information signal as an input to the low pass filter with decimation 18. Low pass filter 18 filters and decimates the $S_I(k)$ signal to provide an output signal labeled "In-phase." The In-phase signal is provided as a first input to each of digital envelope detector 24, adaptive gain compensator 28, and multiplier 30.

An output of multiplier 14 is labeled $S_Q(k)$ and provides a quadrature component of the modulated information signal as an input to the low pass filter with decimation 20. Low pass filter 20 filters and decimates the $S_Q(k)$ signal to provide an output labeled "Quadrature." The Quadrature signal is provided as a second input of digital envelope detector 24, a second input of adaptive gain compensator 28, and a first input of multiplier 32.

Digital envelope detector 24 provides a signal labeled "Envelope." The Envelope signal is provided as a third input to adaptive gain compensator 28. An output of adaptive gain compensator 28 is labeled "Gain" and provides a second input to each of multiplier 30 and multiplier 32. An output of multiplier 30 is provided to high pass filter 34. High pass filter 34 filters the output of multiplier 30 to provide a signal labeled "Channels Composite." The Channels Composite signal is provided as a first input to both adder 44 and adder 48.

An output of multiplier 32 is provided to high pass filter 36. High pass filter 36 filters the output of multiplier 32 to provide a signal labeled "Channels Difference." The Channels difference signal is subsequently provided to a second input of both adder 44 and adder 48.

An output of adder 44 is a signal labeled "L(n)" and an output of adder 48 is a signal labeled "R(n)." Both the L(n) and R(n) signals are provided to an external user of "C-QUAM" receiver system 10.

The output of multiplier 32 is also provided to band pass filter 40 and phase detector 26. An output of band pass filter 40 provides an input to 25 Hz tone detector 42. An output of 25 Hz tone detector 24 provides an output labeled "P(n)" to an external user of "C-QUAM" receiver system 10.

An output of phase detector 26 is provided to an input of loop filter 22. Loop filter 22 provides a signal labeled "Correct" to an input of numerically controlled oscillator 16. Numerically controlled oscillator 16 subsequently provides the I(k) signal which reflects an adjusted phase error to the second input of multiplier 12 and the Q(k) signal which also reflects the adjusted phase error to the second input of multiplier 14.

During operation, multipliers 12 and 14 serve to digitally frequency translate and demodulate the Information signal. Similarly, adaptive gain compensator 28 and multipliers 30 and 32 collectively function to provide the Gain signal containing information necessary to form the left and right channels of an audio signal from the in-phase and quadrature components of the Information signal. Additionally, loop filter 22 and numerically controlled oscillator 16 collectively estimate and correct a phase error of the Information signal.

A software program may be executed within a digital signal processor (not shown) to provide a fully digital implementation of "C-QUAM" digital signal receiver in accordance with the present invention. In the example described herein, stereo receiver system 10 may be implemented using a digital signal processor such as a Motorola DSP56001. Other digital signal processors currently available may also be used to implement the stereo receiver system 10, however.

During operation, a modulated digital signal labeled "Information" is provided to the first input of both multiplier 12 and multiplier 14. The Information signal is typically characterized by the following equation:

$$\text{Information} = [C + L(k) + R(k)]\cos\left(\frac{\omega_c}{\omega_s}k + \gamma(k) + A_1\right). \quad (1)$$

In equation (1), C is a constant value equal to a carrier magnitude of the Information signal, L(k) indicates the magnitude of a left audio channel signal at a predetermined dimensionless time index (k), and R(k) indicates the magnitude of a right audio channel signal at a same predetermined time index (k). An angular center frequency of the Information signal is equal to $\omega_c$ and an angular sampling frequency of the Information signal by the external analog to digital converter (not shown) previously discussed is equal to $\omega_s$. The value (k) is also provided to indicate the time index. A quadrature information signal is reflected in equation (1) by the term $\gamma(k)$, and a phase error information component is represented by the $\phi_e$ term. The quadrature information term $\gamma(k)$ is expressed in the following form:

$$\gamma(k) = \tan^{-1}\left[\frac{L(k) - R(k) + .05\sin\left(\frac{25}{f_s}2\pi k\right)}{C + L(k) + R(k)}\right], \quad (2)$$

where the term (0.05 sin ([25/$f_s$]2$\pi$k)) is a 25 Hz pilot tone used as a reference signal by any conventional AM stereo receiver.

During transmission, a phase angle of an analog signal is altered by surrounding conditions. For example, atmospheric conditions and receiver equipment limitations may modify the phase angle of the transmitted, digital signal. Any phase angle modifications must be approximated and corrected before the signal is output to a user of the receiver, or the signal will sound distorted. Therefore, to enable the receiver to provide a quality audio sound, modifications to the phase angle of the analog signal must be detected and corrected before being provided to the user.

Multipliers 12 and 14 demodulate the Information signal to respectively provide the in-phase sampled output signal labeled "$S_I(k)$" and the quadrature sampled output signal labeled "$S_Q(k)$." To provide the $S_I(k)$ signal, the Information signal is multiplied with a predetermined first output signal labeled "I(k)" provided by numerically controlled oscillator 16. The I(k) signal typically has the form of:

$$I(k) = \cos\left(\frac{\omega_c}{\omega_s}k + \phi_e(k)\right). \quad (3)$$

The $\phi_e(k)$ term of equation (2) provides a phase error correction value necessary to enable receiver system 10 to provide a quality audio signal. Therefore, when multiplier 12 multiplies the Information signal and the I(k) signal, the result is the $S_I(k)$ signal in the form of:

$$S_I(k) = \left[(C + L(k) + R(k))\cos\left(\frac{\omega_c}{\omega_s}k + \gamma(k) + \phi_e(k)\right)\right] \times \left[\cos\left(\frac{\omega_c}{\omega_s}k + \phi_{\hat{e}}(k)\right)\right], \quad (4)$$

which simplifies to equation (5):

$$S_I(k) = \frac{1}{2}[(C + L(k) + R(k))\cos[(\gamma(k) + (\phi_e - \phi_{\hat{e}})]] + D(k), \quad (5)$$

where D(k) is a double frequency term. Additionally, the term k is dropped in the $\phi_e$ and $\phi_{\hat{e}}$ terms as each varies very slowly with time.

Similarly, to provide the $S_Q(k)$ signal, the Information signal is multiplied with a predetermined second output signal labeled "Q(k)" provided by numerically controlled oscillator 16. The Q(k) signal typically has the form of:

$$Q(k) = -\sin\left(\frac{\omega_c}{\omega_s}k + \phi_{\hat{e}}(k)\right). \quad (6)$$

Therefore, when multiplier 14 multiplies the Information signal to the Q(k) signal, the result is the $S_Q(k)$ signal in the form of:

$$S_Q(k) = \left[(C + L(k) + R(k))\cos\left(\frac{\omega_c}{\omega_s}k + \gamma(k) + \phi_e(k)\right)\right] \times \left[-\sin\left(\frac{\omega_c}{\omega_s}k + \phi_{\hat{e}}(k)\right)\right], \quad (7)$$

which simplifies to equation (8):

$$S_Q(k) = \frac{1}{2}[C(1 + L(k) + R(k))]\sin[(\gamma(k) + (\phi_e - \phi_{\hat{e}})] + D(k), \quad (8)$$

where D(k) is again the double frequency term.

The $S_I(k)$ and $S_Q(k)$ signals are respectively a demodulated in-phase component and a demodulated quadrature component of the Information signal. The low pass filters with decimation 18 and 20 both remove the double frequency terms, D(k), and lower the sampling frequency of each of the $S_I(k)$ and $S_Q(k)$ signals.

In this example, low pass filters with decimation 18 and 20 filter the double frequency term, D(k) and subsequently decimate the $S_I(k)$ and $S_Q(k)$ input signals by four, respectively. During decimation, the $S_I(k)$ and $S_Q(k)$ input signals are sampled at a frequency which is a fraction of the input frequency of the signals. For example, when the low pass filter with decimation 18 decimates by four, the $S_I(k)$ signal is sampled at a frequency which is one-fourth the frequency at which the $S_I(k)$ signal is input to the low pass filter with decimation 18. Therefore, a signal output from each one of the low pass filters with decimation 18 and 20 has a sampling frequency which is one-fourth of the frequency at which the signal was input.

Low pass filter with decimation 18 provides the In-phase signal to an input of each of digital envelope detector 24, adaptive gain compensator 28, and multiplier 30. The In-phase signal has the form:

$$\text{In-phase} = \frac{1}{2}[(C + L(n) + R(n))\cos(\gamma(n) + (\phi_e - \phi_{\hat{e}}))]. \quad (9)$$

As shown in equation (9), low pass filter with decimation 18 removes the double frequency term D(k) from the $S_I(k)$ signal. As well, the decimation is reflected by a new time index, n, where n is equal to ([k/4]). Therefore, the $S_I(k)$ signal given by equation (5) is provided without the double frequency term D(k) and at a lower sampling frequency. Low pass filter with decimation 18 may be implemented by using a standard low pass digital filter with a decimation process. The standard low pass digital filter with the decimation process may be digitally implemented as a series of conventional software instructions which is executed in the data processor.

Similarly, low pass filter with decimation 20 provides the Quadrature signal to both an input of digital envelope detector 24, adaptive gain compensator 28, and multiplier 32. The Quadrature signal has the form:

$$\text{Quadrature} = \frac{1}{2}[(C + L(n) + R(n))\sin(\gamma(n) + (\phi_e - \phi_{\hat{e}}))]. \quad (10)$$

As shown in equation (10), low pass filter with decimation 20 removes the double frequency term D(k) from the $S_Q(k)$ signal. As well, the decimation is also reflected by the new time index, n, where n is equal to ([k/4]). Therefore, the $S_Q(k)$ signal given by equation (8) is provided without the double frequency term D(k) and at a lower sampling frequency. Like low pass filter 18, low pass filter with decimation 20 may be implemented by using a standard low pass digital filter with a decimation process. Similarly, the standard low pass digital filter with the decimation process may be digitally implemented as a series of software instructions which is executed in the data processor.

The In-phase and the Quadrature signals respectively provide demodulated decimated in-phase and quadrature signals to the remaining portion of receiver system 10. In the example described herein, the In-phase and Quadrature signals are obtained digitally. However, both signals might also be the sampled inputs of an analog receiver (not shown). Both signals are input to digital envelope detector 24 to provide the Envelope signal. The value of the Envelope signal is determined from both the In-phase and the Quadrature signals and provides a signal indicating the value of the envelope of the Information signal. The Envelope signal has the form:

$$\text{Envelope} = \sqrt{\text{In-phase}^2(n) + \text{Quadrature}^2(n)}. \quad (11)$$

By using commonly known trigonometric identies, equation (11) may be simplified to provide the "Envelope" signal with the form:

$$\text{Envelope} = \frac{1}{2}(C + L(n) + R(n)). \quad (12)$$

Digital envelope detector 24 uses a conventional multiplier circuit (not shown) to compute the square values of the In-phase and the Quadrature signals, a conventional adder circuit (not shown) to add the squares of the In-phase and the Quadrature signals, and a conventional circuit to compute the square root of the composite of the squares of the In-phase and the Quadrature signals. The multiplier circuit, the adder, and the circuit to compute the square root are typically resident in the data processor, and therefore, a software program to enable the data processor to execute the operation performed by the digital envelope detector 24 may be easily implemented.

The output of the digital envelope detector 24, the Envelope signal, is provided to adaptive gain compensator 28. Adaptive gain compensator 28 provides a gain factor which may be used to form a left and a right channel of audio information from each of the In-phase and Quadrature signals. The gain factor is provided by adaptive gain compensator 28 as the Gain signal.

The Gain signal is provided using an iterative process which approximates and corrects a value of the Gain signal. The iterative process is given in the following equation:

$$\text{Gain}_{i+1}=\text{Gain}_i+\Delta[\sigma\cdot\text{Envelope}-\text{Gain}_i\cdot\text{In-phase}]. \quad (13)$$

In equation (13), the subscript i refers to a point in time at which the approximation is being generated. Therefore, when the subscript i+1 is given, an approximation at a subsequent point in time is executing. The "Δ" is a first scaling factor which is chosen to correct a difference between an actual and theoretical value of the $\text{Gain}_i$ signal. Additionally, the $\sigma$ is a second scaling factor which is used to modify the Envelope signal to equal the product of the Gain and In-phase signals. Both the Δ and $\sigma$ values are chosen in accordance with characteristics of receiver system 10 and will vary for each system used.

During operation, the iterative process of equation (13) is complete when $\text{Gain}_{i+1}$ equals $\text{Gain}_i$. To achieve this equality, it is necessary for the "$\sigma\cdot$Envelope—$\text{Gain}_i\cdot$In-phase" portion of equation (13) to converge to zero. By arithmetically manipulating the aforesaid portion of equation (13), the following relationship may be extracted:

$$\text{Gain}_i\cdot\text{In-phase}=\frac{\sigma\cdot\text{Envelope}}{\text{In-phase}} \quad (14)$$

Equation (14) may be further simplified by combining equation (9) with equation (12) to provide the following relationship. Phase error is considered to be negligible.

$$\text{In-phase}=\text{Envelope}\cdot\cos\gamma(n) \quad (15)$$

When the relationship given in equation (15) is applied to equation (14), the value of the Gain signal is expressed as:

$$\text{Gain}_i=\frac{\sigma}{\cos\gamma(n)} \quad (16)$$

Therefore, by using multiplier 30 to multiply the In-phase and the Gain signals, a resulting product has the form:

$$\text{Gain}_i\cdot\text{In-phase}=\sigma\cdot\text{Envelope} \quad (17)$$

-continued $$\text{Gain}_i\cdot\text{In-phase}=\frac{\sigma}{2}(C+L+R) \quad (18)$$

The in-phase component of the Information signal is reflected in the composite of the left and right channels of the audio signal. Next, to obtain quadrature information from the Information signal input to receiver system 10, a signal containing the difference between the left and right channels must be extracted from the Information signal. As in the in-phase component of the Information signal, equation (10) is combined with equation (12) to provide the following relationship:

$$\text{Quadrature}=\text{Envelope}\cdot\sin\gamma(n). \quad (19)$$

Subsequently, multiplier 32 is used to multiply the Quadrature signal and the Gain signal with the following result:

$$\text{Quadrature}\cdot\text{Gain}=(\text{Envelope}\cdot\sin\gamma(n))\left(\frac{\sigma}{\cos\gamma(n)}\right) \quad (20)$$

$$\text{Quadrature}\cdot\text{Gain}=\sigma\cdot\text{Envelope}\cdot\tan\gamma(n). \quad (21)$$

As was previously stated in equation (2):

$$\tan\gamma(n)=\frac{L-R+P}{C+L+R}. \quad (22)$$

as was shown in equation (12), Envelope is equal to "[½](C+L+R)". Therefore, $$\tan\gamma(n)=\frac{L-R+P}{2\cdot\text{Envelope}}. \quad (23)$$

By combining equations (20) and (23), the product of the Quadrature and Gain signals is equal to:

$$\text{Quadrature}\cdot\text{Gain}=\frac{\sigma}{2}(L-R). \quad (24)$$

Each of the outputs of multipliers 30 and 32 is then high pass filtered by high pass filters 34 and 36, respectively. High pass filter 34 removes the constant value "C" from the product provided by multiplier 30 to provide the Channels Composite signal of the form:

$$\text{Channels Composite}=L+R. \quad (25)$$

Similarly, high pass filter 36 removes the pilot tone "P(n)" from the product output by multiplier 32 to provide the Channels Difference signal. The Channels Difference signal has the form:

$$\text{Channels Difference}=L-R. \quad (26)$$

The Channels Difference signal is negated and added to the Channels Composite signal by adder 48 to produce a signal labeled "R(n)." The R(n) signal provides right stereophonic information to a user of receiver 10. Similarly, the Channels Difference signal provides a second input to adder 44. Adder 44 adds the Channels Difference and Channels Composite signals to provide a signal labeled "L(n)." The L(n) signal provides left stereophonic information to the user of receiver system 10.

By allowing only frequencies within a predetermined range of frequencies to be output from band pass filter 40, the in-phase and quadrature information signals and the phase error information are not output from band pass filter 40. Rather, band pass filter 40 allows only the pilot frequency signal P(n) to pass through and be output to the 25 Hz Tone Detector 42. Upon receipt of the P(n) signal, the 25 Hz Tone Detector 42 provides a signal to indicate that the pilot signal P(n) is present.

The phase error which occurs during transmission of the Information signal is typically due to time delay, atmospheric conditions, or receiver non-linearities. Both atmospheric conditions and receiver non-linearities generally modify the phase of the Information signal with a low frequency signal. Therefore, phase detector 26 is basically a low pass filter which detects the phase error inherent in the Information signal. Detector 26 is a conventional low pass digital filter circuit which is digitally implemented as a software program executed by the data processor. Phase detector 26 is connected to loop filter 22 to provide an output which includes only phase error information. The filtering operation executed by phase detector 26 may be executed using standard and conventional logic circuitry controlled by a predetermined software program. A sample of a predetermined software program written for use with a Motorola DSP56001 is provided in Appendix I.

When the loop filter 22 receives the output of multiplier 32, the Correct signal is provided. The Correct signal is then provided to numerically controlled oscillator 16. Numerically controlled oscillator 16 then uses the Correct signal to generate the I(k) and Q(k) signals.

Operations executed by numerically controlled oscillator 16 may be executed using standard and conventional logic circuitry or by a predetermined software program in a data processor. A next sample of the Information signal is demodulated with the multipliers 12 and 14, and the phase error of the signal is approximated by numerically controlled oscillator 16. Therefore, the phase angle of the signal is approximated and iteratively converged by calculating the sine and cosine of the phase error.

Figure 2:
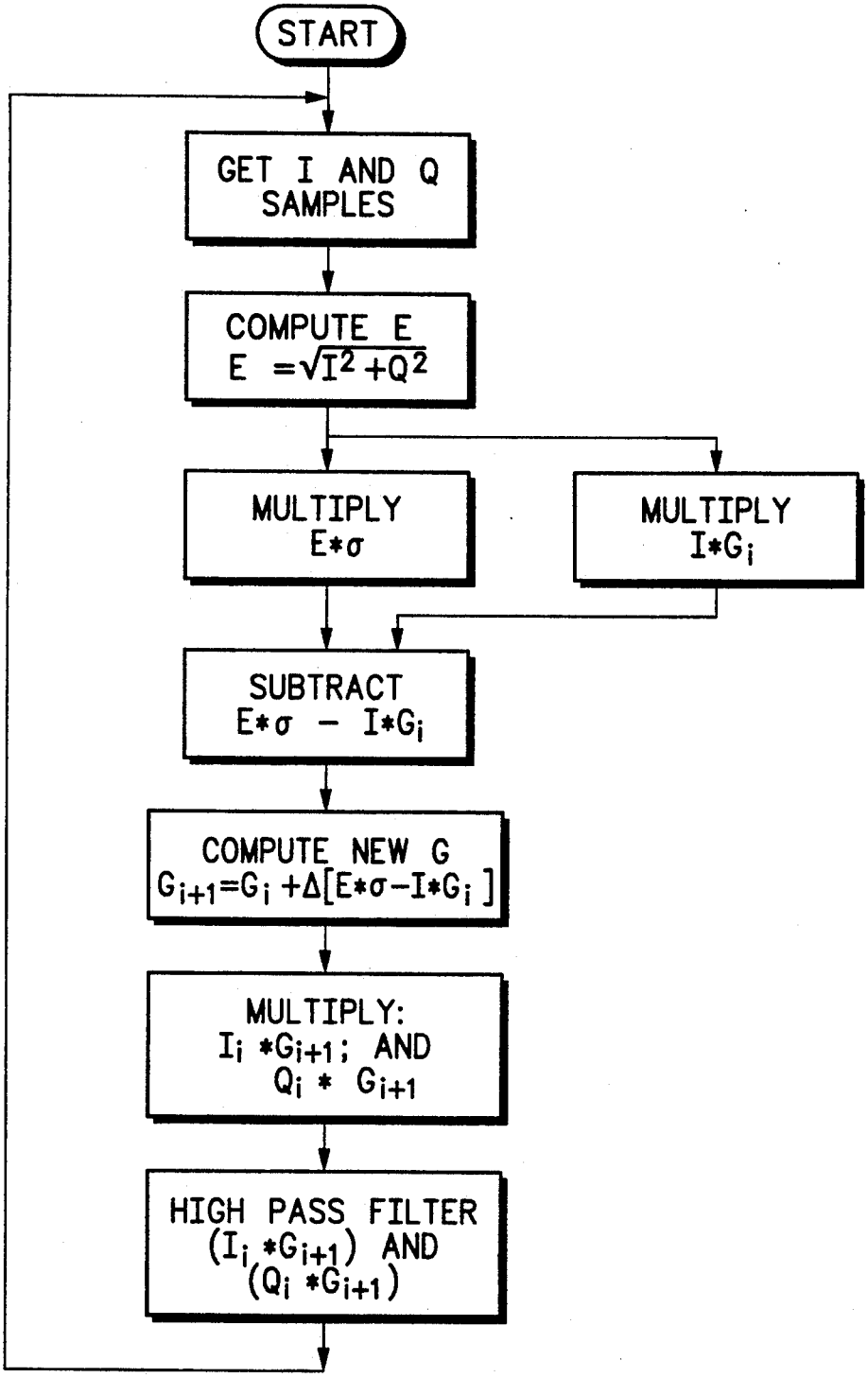
FIG. 2 illustrates in flow chart form a series of steps which are executed by the base band processor in accordance with the present invention.

FIG. 2 provides a flow chart of the series of steps executed by the base band processor described herein to separate the left and right audio channels of the Information signal. As was previously described, the base band processor includes adaptive gain compensator 28, multipliers 30 and 32, and high pass filters 34 and 36. Each of the functions required to perform the operations executed by the base band processor described herein may be performed with a software program. An example of one software implementation is provided in Appendix I. The software program in Appendix I is executed by a Motorola DSP56001 digital signal processor.

Referring to FIG. 2, the steps necessary to separate the Information signal into a left and a right channel may be summarized as follows:

1. Obtain In-phase and Quadrature signals;
2. Compute Envelope value (equations (11) and (12));
3. Concurrently, multiply the Envelope signal by $\sigma$ and multiply the In-phase signal by the Gain signal;
4. Subtract the product of the In-phase and Gain signals from the product of the Envelope signal and $\sigma$
5. Compute the $Gain_{i+1}$ value using the formula given in equation (13)
6. Concurrently, multiply the In-phase signal by $Gain_{i+1}$ and multiply the Quadrature signal by $Gain_{i+1}$; and
7. High pass filter each of the products formed in step 6 to provide both a composite signal having both the left and right channels of audio information, and a difference signal which also has both the left and right channels of audio information.

In the base band processor described herein, the left and right channels are balanced with respect to each other. The Gain signal is concurrently provided to both multiplier 30 and multiplier 32. Additionally, high pass filter 34 and 36 are implemented identically such that they are matched and provide outputs at the same rate. Similarly, adders 44 and 48 receive and arithmetically manipulate a Channels Composite signal and a Channels Difference signal concurrently such that the left audio information corresponds to the right audio information. Because the operations performed on each of the in-phase and quadrature components of the Information signal are executed concurrently and symmetrically, the left and right audio signals are "naturally" balanced by the design of the system and do not require compensating circuitry as was previously required in analog implementations of C-QUAM receivers. Therefore, the complexity of the base band processor described herein is greatly simplified by the symmetrical nature of both the circuit and method used to produce the left and right channels of audio information.

Additionally, the implementation of the AM receiver described herein may be fully implemented using digital, rather than analog logic. Therefore, noise associated with the discrete components of an analog solution is not present. However, an analog demodulator may also be used to provide the In-phase and Quadrature signals to the inputs of the base band processors. Additionally, by using a digital solution, the left and right channels of audio information may be generated exactly rather than approximated as was performed by analog components. Subsequently, a clearer, more accurate reproduction of the audio sound is generated. Receiver system 10 is also able to provide better quality audio sound because the adaptive gain compensator is multiplied by both the In-phase signal and the Quadrature signal after each has been filtered and decimated to a lower frequency. As was previously stated, the gain factor may be generated more accurately at lower frequencies. Additionally, the low pass filtering serves to remove a substantial portion of the noise generated during transmission of the Information signal.

Furthermore, each of the steps and functions performed by the digital receiver described herein may be implemented as a software program. The software program would be subsequently executed by a digital data processor. In particular, current hardware implementations of digital signal processor devices would adequately support the requirements of the digital "C-QUAM" stereo receiver system 10 described herein.

It should be well understood that the digital "C-QUAM" stereo receiver system described herein provides a wide variety of sound enhancements. The implementation of the invention described herein is provided by way of example only, however, and many other implementations may exist for executing the function described herein. For example, a plurality of software programs may be provided to respectively perform the arithmetic functions executed by each of the components of the receiver system 10. The plurality of software programs are provided by the user of the receiver system 10 and may be executed on any one of a plurality of digital data processors. Additionally, the plurality of software programs may be slightly modified to enable each one of the plurality of digital data processors to perform the arithmetic functions described above.

Each one of the components of the receiver system 10 may be digitally implemented in a software program and executed in a digital data processing system. A series of software instructions would enable a typical digital signal processor to execute each of the functions performed by multiplier 12, multiplier 14, numerically controlled oscillator 16, low pass filter with decimation 18, low pass filter with decimation 20, loop filter 22, digital envelope detector 24, phase detector 26, adaptive gain compensator 28, multiplier 30, multiplier 32, high pass filter 34, high pass filter 36, adder 44, adder 48, band pass filter 40, and 25 Hz tone detector 42. For example, a single general purpose multiplier in the digital signal processor may be used to perform each of the functions executed by multiplier 12, multiplier 14, multiplier 30, and multiplier 32.

Additionally, the form and content of the software program is dependent on the user of the receiver system 10. The circuitry used to perform the mathematical computations required by the software programs is implemented in a conventional form. Conventional adders, multipliers, and dividers are typically used to implement a software program to perform the functions described herein.

While there have been described herein the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

Appendix I

This subroutine performs the function of determining tan ($\phi_e - \phi_{\hat{e}}$) with a low pass filter in a Motorola DSP56001 digital signal processor. For further information on the software instructions implemented within the subroutine, refer to "DSP56000/DSP56001 Digital Signal Processor User's Manual, (DSP56000UM/AD)" published by Motorola Inc. in 1989. In FIG. 1, this subroutine is represented by phase detector 26. The input to the detector is the output of the quadrature channel manipulator 38. It is called qstar in this program. The pointers r6 and r7 respectively point to the previous input and output data of the phase detector 26. The terms lpfr6, lpfr7, lpfcddr, and nomod are labels which indicate offset values determined by a user of the DSP56001. The pointer r2 points to coefficients of the low pass filter. The modulo addresses m2, m6, and m7 are determined accordingly.

```
org p:$100
move    y:qstar, y1        ;move the output of the
                           ;quadrature channel
                           ;manipulator 38 into
                           ;register y1
move    x:lpfr6,r6         ;move the location of the
                           ;previous input data into
                           ;pointer r6
move    x:lpfr7,r7         ;move the location of the
                           ;previous input data into
                           ;pointer r7
move    x:lpfcddr,r2       ;move the location of the
                           ;filter coefficient into
                           ;pointer r2
move    #1,m6              ;set up modulo addresses
move    m6,m7
move    #nomod, m2
move    x:(r2)+,x0         ;move the first filter
                           ;coefficient into register x0
```

The following five instructions perform the filter, accumulating

Appendix I-continued the result in a register a and incrementing through the coefficients, the old input data and the old output data. On the last instruction, the latest input data is stored to a memory location for use when the next sample is filtered. The output of the filter is moved to register x1, and will then become the input to the loop filter 22.

```
mpy     x0,y1,a x:(r2)+,x0    y:(r6)+,y0
mac     x0,y0,a x:(r2)+,x0    y:(r6), y0
mac     x0,y0,a x:(r2)+,x0    y:(r7)+,y0
mac     x0,y0,a x:(r2)+,x0    y:(r7),y0
mac     x0,y0,a               y1,y:(r6)
```

The final line of code moves the filter to register x1 and moves the new output into the new output memory for use on the next sample to be filtered.

```
move    a,x1                  a,y:(r7)
```

Appendix II

This subroutine performs the function of providing the Gain signal as disclosed in the specification in a Motorola DSP56001 digital signal processor. For further information on the software instructions implemented within the subroutine, refer to "DSP56000/DSP56001 Digital Signal Processor User's Manual, (DSP56000UM/AD)" published by Motorola Inc. in 1989. In FIG. 1, this subroutine is represented by both digital envelope detector 24 and adaptive gain compensator 28. A first input to envelope detector 24 is the In-Phase signal which is called "iin" in this program. A second input to envelope detector 24 is the Quadrature signal which is called "qin" in this program.

```
org p:start
move    x:ichannel,x0      ;move the output of the
                           ;low pass filter with
                           ;decimation 18 into register
                           ;x0-this is the In-phase
                           ;signal as shown in FIG. 1
move    y:qchannel,y0      ;move the output of the
                           ;low pass filter with
                           ;decimation 20 into register
                           ;y0-this is the Quadrature
                           ;signal as shown in FIG. 1
move    x0,x:iin           ;store the value transferred
                           ;by the In-phase signal in a
                           ;storage location specified
                           ;by x:iin
move    y0,y:qin           ;;store the value transferred
                           ;by the Quadrature signal
                           ;in a storage location
                           ;specified by y:qin
mpy     x0,x0,a x0,b       ;Square the value
                           ;transmitted via the In-
                           ;phase signal and store the
                           ;results in register a
macr    y0,y0,a b,x1       ;Square the value
                           ;transmitted via the
                           ;Quadrature signal and add
                           ;the squared value to the
                           ;square of the In-phase
                           ;signal already stored in
                           ;register a-Store the sum in
                           ;register a
move    a,x0               ;move the contents of
                           ;register a into register x0
jmp     <sqrt              ;Jump to a subroutine
                           ;which executes a square
                           ;root function-the result of
                           ;the square root function is
                           ;the output of digital
                           ;envelope detector 24, the
                           ;Envelope signal which is
                           ;stored in register b
rep     #3                 ;arithmetically shift the
                           ;Envelope signal three
                           ;times to the right to
                           ;effectively multiply the
                           ;Envelope signal by σ— in
                           ;the example described
                           ;herein, σ=.125.
asr     b
move    x:iin,x0           ;move the value
                           ;transferred by the In-phase
                           ;signal to register x0
move    y:gainfactor,y1    ;move a previously stored
```

Appendix II-continued

| | | |
|---|---|---|
| | | ;value of the Gain signal to ;register y1 |
| mpy | x0,y1,a | ;Multiply the value ;transferred by the In-phase ;signal and the value ;transferred by the ;previously stored Gain ;signal and store the results ;in register a |
| sub | a,b #>bgainm1,y0 | ;Subtract the contents of ;register a from the ;contents of register b ;(Envelope·σ− In- ;phase·Gain$_i$) |
| clr | a b,x1 | ;clear register a for ;subsequent operations |
| move | y1,a | ;move the previously ;stored value of the Gain ;signal to register a |
| macr | x1,y0,a y:qin, y0 | ;Gain$_{i+1}$ = I SU(i=0,m, ;Gain$_i$ + Δ[σ·Envelope− ;Gain$_i$·In-phase]), store ;the result in register a |
| move | a,y1 | ;Move the contents of ;register a (the Gain$_{i+1}$) ;into register y1 |
| mpy | y1,y0,a a,y:gainfactor | ;Multiply the value ;transferred via the ;Quadrature signal times ;the value of the ;Gain$_{i+1}$ *signal, store the* ;result in the register a |
| mpy | y1,x0,b | ;Multiply the value ;transferred via the In- ;phase signal times the ;value of the Gain$_{i+1}$ ;signal, store the result in ;the register b |

Subsequently, the contents of each of registers a and b are filtered by high pass filter 34 and high pass filter 36, respectively.

We claim:

1. A base band processor for a quadrature receiver having an envelope detector, the quadrature receiver receiving a demodulated signal with an in-phase component and a quadrature component, the envelope detector providing an envelope signal in response to both the in-phase component and the quadrature component, the base band processor comprising:

adaptive gain means for providing a gain coefficient, the adaptive gain means having a first input coupled to the envelope detector for receiving the envelope signal and a second input for receiving the in-phase component;

first logic means for logically combining the gain coefficient and the in-phase component of the demodulated signal to provide a composite signal having a modified amplitude, the first logic means being coupled to the adaptive gain means for receiving the gain coefficient;

second logic means for logically combining the gain coefficient and the quadrature component of the demodulated signal to provide a difference signal having the modified amplitude, the difference signal and the composite signal being concurrently provided, the second logic means being coupled to the adaptive gain means for receiving the gain coefficient; and dematrixing means for providing a right audio information signal and a left audio information signal in response to the composite signal and the difference signal, the dematrixing means being coupled to the first logic means for receiving the composite signal and the dematrixing means being coupled to the second logic means for receiving the difference signal.

2. The base band processor of claim 1 further comprising:

a frequency filter coupled to the first logic means for receiving the composite signal, the frequency filter also being coupled to the second logic means for receiving the difference signal, the frequency filter filtering a first predetermined portion of the composite signal and concurrently filtering a second predetermined portion of the difference signal.

3. The base band processor of claim 1 wherein the first logic means and second logic means comprise multipliers.

4. The base band processor of claim 1 wherein the dematrixing means comprises:

a first adder having a first input coupled to the first logic means for receiving the composite signal, the first adder having a second input coupled to the second logic means for receiving the difference signal, the first adder summing the composite signal and the difference signal to provide the left audio information signal; and a second adder having a first input coupled to the first logic means for receiving the composite signal, the second adder having a second output coupled to the second logic means for receiving the difference signal, the second adder subtracting the difference signal from the composite signal to provide the right audio information signal.

5. A method for processing an amplitude modulated signal in a digital receiver having a symmetrically balanced phase and amplitude base band processor for a quadrature receiver, comprising the steps of:

digitally demodulating the amplitude modulated signal to provide a demodulated signal with an in-phase component and a quadrature component;

providing an envelope signal by using both the in-phase component and the quadrature component of the demodulated signal;

providing a gain coefficient by using the envelope signal and the in-phase component;

logically combining the gain coefficient and the in-phase component of the demodulated signal to provide a composite signal having a modified amplitude;

logically combining the gain coefficient and the quadrature component of the demodulated signal to provide a difference signal having the modified amplitude, the difference signal and the composite signal being concurrently provided;

adding the composite signal and the difference signal to provide a left audio information signal; and subtracting the difference signal from the composite signal to provide a right audio information signal.

6. The method of claim 5 further comprising the step of:

filtering a first predetermined portion of the composite signal and filtering a second predetermined portion of the difference signal concurrently.

7. A quadrature modulated digital stereo receiver, comprising:

digital demodulation means for providing a demodulated signal with an in-phase component and a quadrature component, the digital demodulation means having a first input for receiving a digital modulated input signal and a second input for receiving a phase error correction signal;

filter and decimation means coupled to the digital demodulation means for providing a decimated signal with an in-phase component and a quadrature component;

digital envelope detector means for providing an envelope signal, the digital envelope detector being coupled to the filter and decimation means and having a first input for receiving the in-phase component of the decimated signal and a second input for receiving the quadrature component of the decimated signal;

adaptive gain means for providing a gain coefficient, the adaptive gain means having a first input coupled to the envelope detector for receiving the envelope signal and a second input for receiving the in-phase component;

first logic means for logically combining the gain coefficient and the in-phase component of the demodulated signal to provide an intermediate composite signal having a modified amplitude, the first logic means being coupled to the adaptive gain means for receiving the gain coefficient;

second logic means for logically combining the gain coefficient and the quadrature component of the demodulated signal to provide an intermediate difference signal having the modified amplitude, the intermediate difference signal and the intermediate composite signal being concurrently provided, the second logic means being coupled to the adaptive gain means for receiving the gain coefficient;

phase error detector for providing a phase error information value, the phase error detector being coupled to the second logic means for receiving the intermediate difference signal;

loop filter coupled to the phase error detector for providing the phase error correction signal in response to receiving and using the predetermined phase error information value;

a frequency filter coupled to the first logic means for receiving the intermediate composite signal, the frequency filter also being coupled to the second logic means for receiving the intermediate difference signal, the frequency filter concurrently filtering a first predetermined portion of the intermediate composite signal to provide a channels composite signal and filtering a second predetermined portion of the intermediate difference signal to provide a channels difference signal; and arithmetic logic means for providing a left audio information signal and a right audio information signal, the arithmetic logic means having a first input coupled to the frequency filter for receiving the channels composite signal, the arithmetic logic means having a second input coupled to the frequency filter for receiving the channels difference signal.

8. The arithmetic logic means of claim 7, further comprising:

a first adder having a first input coupled to the frequency filter for receiving the channels composite signal, the first adder having a second input coupled to the frequency filter for receiving the channels difference signal, the first adder summing the channels composite signal and the channels difference signal to provide a left audio information signal; and a second adder having a first input coupled to the frequency filter for receiving the channels composite signal, the second adder having a second output coupled to the frequency filter for receiving the channels difference signal, the second adder substracting the channels difference signal from the channels composite signal to provide a right audio information signal.

9. A method of operation in a digital signal processor for demodulating a quadrature amplitude modulated signal to provide audio information, comprising the steps of:

digitally demodulating the amplitude modulated signal to provide a demodulated signal with an in-phase component and a quadrature component;

filtering and decimating the demodulated signal to provide a decimated signal with an in-phase component and a quadrature component;

generating an envelope signal by using both the in-phase component and the quadrature component of the decimated signal;

generating a gain coefficient by using the envelope signal and the in-phase component of the decimated signal;

logically combining the gain coefficient and the in-phase component of the decimated signal to provide an intermediate composite signal having a modified amplitude;

logically combining the gain coefficient and the quadrature component of the decimated signal to provide an intermediate difference signal having the modified amplitude, the intermediate difference signal and the intermediate composite signal being concurrently provided;

generating a phase error information value in response to the intermediate difference signal;

providing a phase error correction signal in response to the phase error information value, the phase error correction signal being used to correct a phase error of the amplitude modulated signal;

filtering a first predetermined portion of the intermediate composite signal to provide a channels composite signal;

filtering a second predetermined portion of the intermediate difference signal to concurrently provide a channels difference signal;

adding the channels composite signal and the channels difference signal to provide a left audio information signal; and subtracting the channels difference signal from the channels composite signal to provide a right audio information signal.

10. A method for processing an amplitude modulated signal in an analog receiver having a symmetrically balanced phase and amplitude base band processor for a quadrature receiver, comprising the steps of:

analog demodulating the amplitude modulated signal to provide a demodulated signal with an in-phase component and a quadrature component;

sampling the in-phase component to provide a digital in-phase component;

sampling the quadrature component to provide a digital quadrature component;

providing an envelope signal by using both the digital in-phase component and the digital quadrature component of the demodulated signal;

providing a gain coefficient by using the envelope signal and the in-phase component;

logically combining the gain coefficient and the digital in-phase component of the demodulated signal to provide a composite signal having a modified amplitude;

logically combining the gain coefficient and the digital quadrature component of the demodulated signal to provide a difference signal having the modified amplitude, the difference signal and the composite signal being concurrently provided;

adding the composite signal and the difference signal to provide a left audio information signal; and subtracting the difference signal from the composite signal to provide a right audio information signal.

11. The method of claim 10 further comprising the step of:

filtering a first predetermined portion of the composite signal and filtering a second predetermined portion of the difference signal concurrently.

* * * * *